United States Patent [19]

Mehls

[11] 4,207,714

[45] Jun. 17, 1980

[54] BUILDING CONSTRUCTION

[76] Inventor: William L. Mehls, 44 E. Elm St., Chippewa Falls, Wis. 54729

[21] Appl. No.: 972,452

[22] Filed: Dec. 22, 1978

[51] Int. Cl.[2] ..... E04B 1/348

[52] U.S. Cl. ..... 52/79.9; 52/79.1; 52/90; 52/92

[58] Field of Search ..... 52/79.9, 79.8, 79.7, 52/79.5, 79.1, 92, 91

[56] References Cited

U.S. PATENT DOCUMENTS

| | | | |
|---|---|---|---|
| 2,287,229 | 6/1942 | Carpenter | 52/79.9 |
| 2,706,313 | 4/1955 | Radman | 52/79.9 |
| 3,177,618 | 4/1965 | Jacob | 52/90 |
| 3,460,297 | 8/1969 | Fritz | 52/66 |
| 3,714,746 | 2/1973 | Barlow | 52/66 X |
| 3,835,600 | 9/1974 | Padula et al. | 52/67 |
| 3,986,306 | 10/1976 | Trannoy | 52/90 X |

FOREIGN PATENT DOCUMENTS

| | | | |
|---|---|---|---|
| 2604948 | 8/1977 | Fed. Rep. of Germany | 52/79.1 |
| 2268927 | 11/1975 | France | 52/79.7 |
| 6804097 | 10/1968 | Netherlands | 52/79.9 |
| 1158708 | 7/1969 | United Kingdom | 52/79.1 |

*Primary Examiner*—Alfred C. Perham
*Attorney, Agent, or Firm*—Michael E. Kiteck, Jr.

[57] ABSTRACT

A construction primarily useful for A-frame buildings with two lower sections adapted to be installed side by side to form the lower portion of the building and an upper section adapted to be mounted in a centered position over the two lower sections to form a generally triangular A-frame building. The sections are individually preassembled in a factory and are of a limited width to enable them to be transported lengthwise over conventional highways to the building site.

5 Claims, 4 Drawing Figures

BUILDING CONSTRUCTION

BACKGROUND OF THE INVENTION

It has been found economical and practical to build houses or the like in a factory on an assembly line basis where fixtures, as well as wiring, plumbing, heat ducts and the like can be installed and the building then shipped in sections to the building site leaving a minimum of time and labor for the actual erection.

Examples of such sectional or modular buildings are found in U.S. Pat. Nos. 2,287,229 and 3,835,600. The structures in these patents are rather conventional vertical wall buildings.

In relatively recent years the A-frame construction has become increasingly popular particularly for vacation homes or the like. This is due to the fact that the general rectangular cross sectional design of the building permits two stories or levels while the roof and each side wall formed of a common wall panel affording economy in construction.

In the past others have designed A-frames which may be factory manufactured to obtain the advantages thereof and then transported to location where it is to be erected or used. However, these have involved hinging wall sections together for collapse during transport. Examples of such structures are found in U.S. Pat. Nos. 3,460,297 and 3,714,746. Such structures have certain disadvantages in structural weaknesses and not enabling complete installation of interior fixtures or the like at the factory.

SUMMARY OF THE INVENTION

An object of the present invention is to provide an A-frame structure utilizing three sections which may be built in a factory and then transported within normal highway width transport restrictions to a building site and then readily assembled and which after assembly will have an extremely strong truss structure.

Another object is to provide an A-frame structure which may be factory built for later erection on a building site which has the pleasing external aesthetic appearance identical to that which such a building would have if it were constructed entirely from basic building materials on the site.

With these and other objects in view the invention broadly comprises an A-frame building formed of two lower complementary structural sections having upwardly converging outer side walls when the sections are placed in opposing position and a top section supported centrally above the lower sections and having downwardly diverging side walls respectively aligned with the side walls on the lower sections with said side walls being supported by interior stud members which are adatped to interlock between the upper and lower walls and which are bolted together to provide a rigid frame structure between the lower and upper sections. The lower sections are also provided with floor panels which are bolted together.

DESCRIPTION OF THE PREFERRED EMBODIMENT

Figure 1:
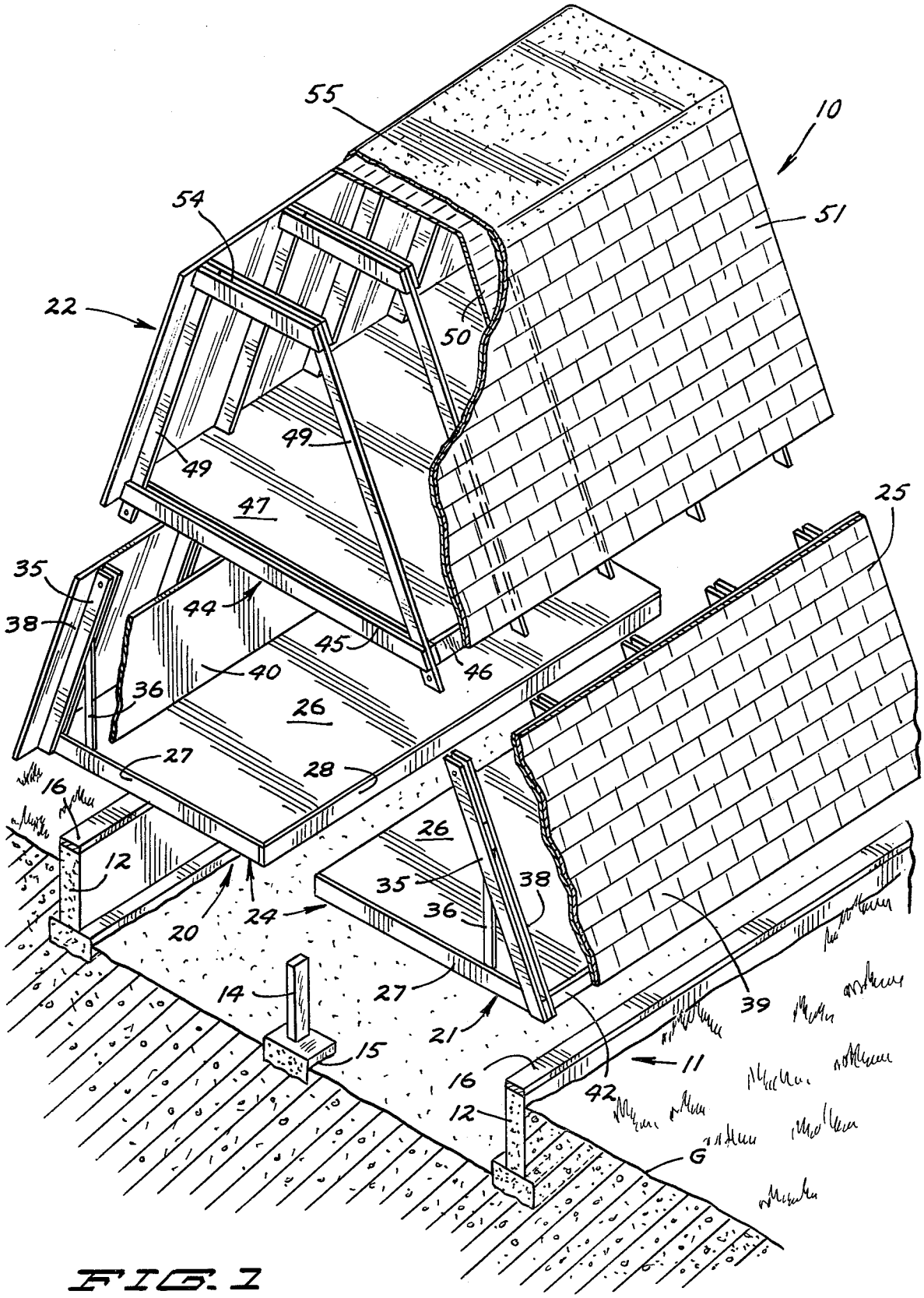
FIG. 1 is a perspective view of the sections in exploded relative position over a foundation. The section walls are partially broken away to show the interior construction.
Figure 2:
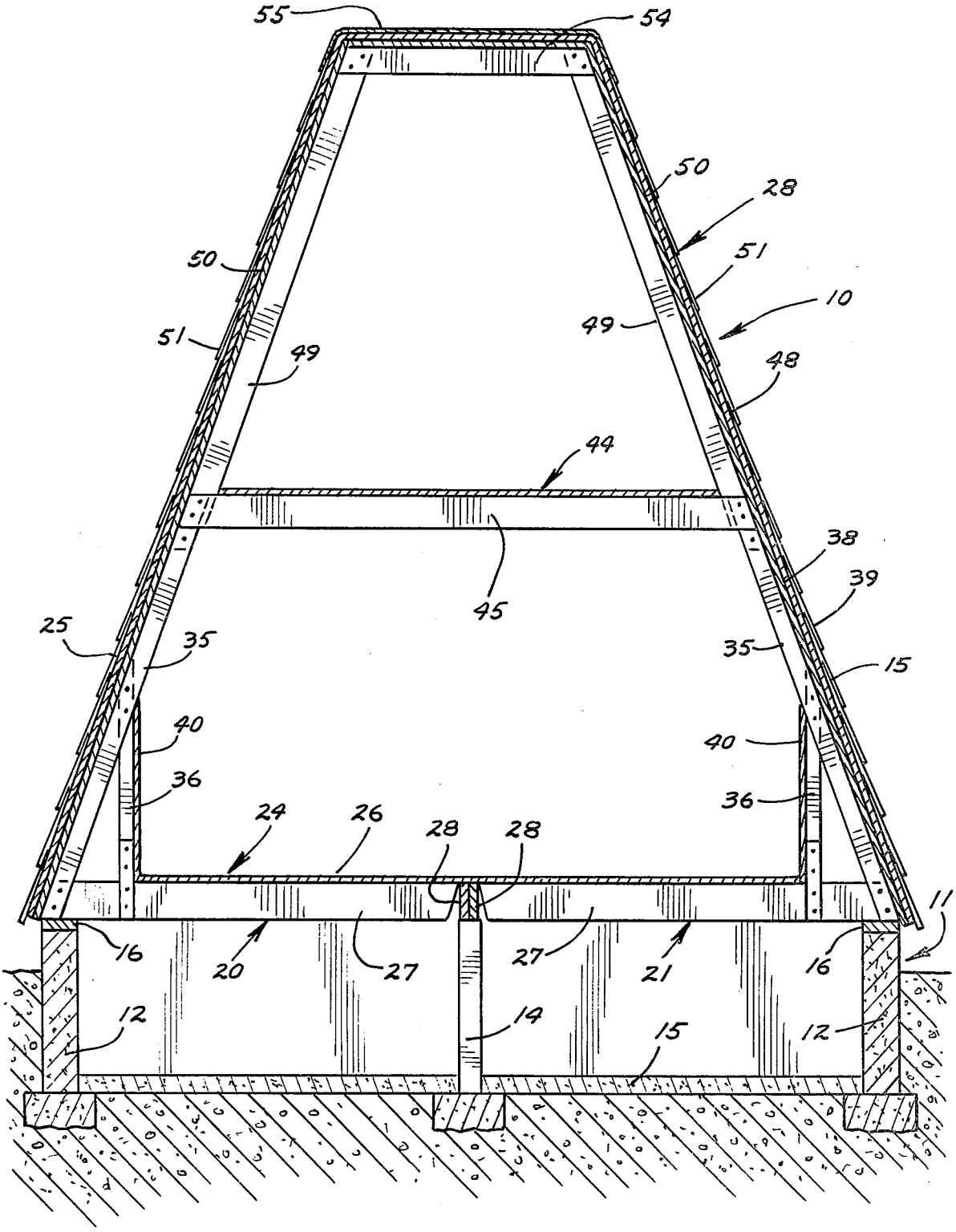
FIG. 2 is a front elevation of the sections in assembled condition and resting on the foundation.

Referring now more particularly to the drawings, reference characters will be used to denote like parts or structural features in the different views. The A-frame in general is designated by the numeral 10 and is adapted to be mounted on a foundation designated generally at 11 which may comprise spaced parallel footings 12, a plurality of center posts 14 spaced equidistantly between footings 12 and a bottom slab 15. The foundation members would normally be formed of concrete or comparable material. Posts 14, however, could be of wood anchored in a concrete base as shown. The footing members 12 should be provided with sills 16, also of wood, spaced above the level of ground G upon which the A-frame may be set to rest. The foundation 11 may take many forms and is not a part of the present invention.

The A-frame structure 10 has a pair of lower or bottom sections 20 and 21 and a top section 22. These sections may be built of varying lengths, preferably of predetermined increments such as four feet depending on the intended use of the building. The sections 20 and 21 are identical in basic construction but are used reversely to complement each other in the finished building. Each is provided with a floor 24 and an upright side wall 25 angling upwardly and inwardly from floor 24.

The floor 24 includes a floor panel 26 supported on joist members 27 and 28 which respectively extend crosswise and longitudinally of the building. Joists 28 run side by side on the two sections 20 and 21 and are provided with aligned apertures 29 for receiving bolts 30 held by nut and washer assemblies 31.

Each of the sections 20 and 21 is provided with an outer side wall 25. This is formed by upright stud members 35 which angle inwardly in their upward extension from the floor 24. Members 35 are each formed of a pair of spaced boards the lower ends of which are preferably secured on each side of the outer end of a joist 27. There is also a brace 36 extending upwardly from joist 27 to a medial point on member 35. An outer wall panel 38 is secured along the outer sides of stud members 35. This panel has its outer surface covered with shingles 39. Each panel 38 preferably has its inner surface covered with a layer of insulation material and an inner wall finished surface covering arranged in a sandwich relation. An inside wall panel 40 forms a short hip wall secured to the inner edges of braces 36. The area between the panels 36 and 40 is used for electrical, heating or plumbing runways as well as for storage.

Floor 24 of sections 20 and 21 also each has a series of spaced joists (not shown) extending parallel to joist member 28 with the outermost of said joists, denoted at 42 in FIG. 1, adapted to rest upon the sill 16 of the foundation. Joist members 28 rest upon center posts 14.

The top section 22 of the A-frame structure 10 will now be described. Sections 22 are built of the same lengths as sections 20 and 21. This section has a floor, denoted generally at 44, which comprises spaced pairs of joists 45 extending crosswise and spaced longitudinally extending joists 46 which jointly support a floor panel 47.

Section 22 is generally triangular and has opposing identical side walls, denoted generally at 48, which angle upwardly and inwardly from the floor 44. Walls 48 are formed by upright stud members 49 which gradually converge in their upward extension. These are spaced apart so as to fit into and between the pairs of boards in sections 20 and 21 forming stud members 35. Wall panels 50 are secured to the outer sides of studs 49 and are covered by shingles 51. The upper ends of members 49 are interconnected by rafter members 54 which support a shingled roof 55.

Figure 3:
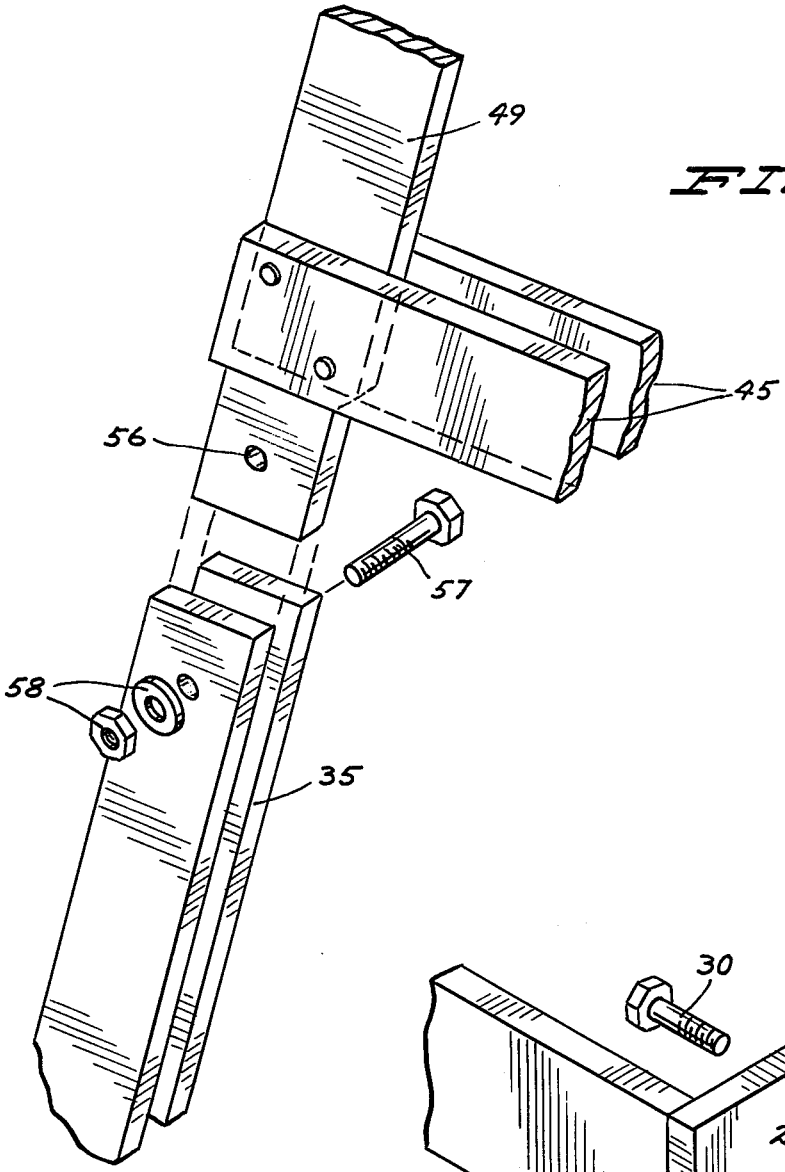
FIG. 3 is an exploded view of the connectible end portions of the studs or wall supports and a connecting bolt and nut assembly therefor.

The stud members 49 are apertured as at 56 and connected to the stud members 35 by bolts 57 held in place by nut and washer assemblies 59 as best understood by observance of FIG. 3.

It will be understood that the phrase "generally triangular" as used herein in describing section 22 includes a true triangular shape as well as a trapezoidal shape shown or any comparable structure wherein the side walls converge upwardly.

Modular window dormers may be built into or attached to the side walls 25 and 48 if desired. Such dormers may be mounted singly or in groups to create variations in living space and layout.

It will be understood that the sections 20, 21 and 22 are preassembled in predetermined lengths in a manufacturing facilty. Interior walls, carpeting, plumbing, heating and wiring facilities for later connection can also be built into the sections. Each of the sections has a limited width such as to meet highway transportation restrictions.

Figure 4:
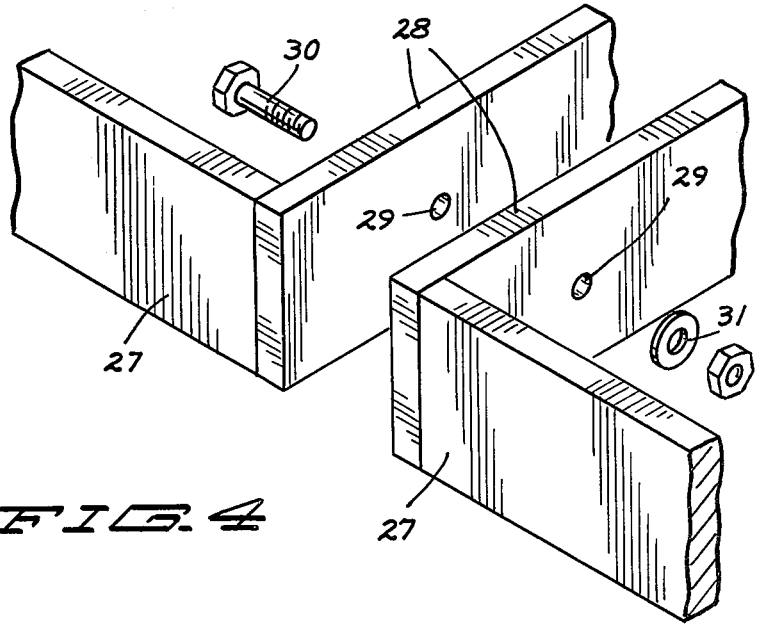
FIG. 4 is an exploded view of sections of the floor beams and a connecting bolt and nut assembly therefor.

When the sections have been transported to the building site they are readily assembled upon the foundation 11 by the bolt and nut assemblies shown in FIGS. 3 and 4. Suitable means may be used to secure the structure to the center posts 14 and sills 16. It may be desirable to apply the shingles 39 and 51 after the sections have been assembled depending on the situation. However, it is preferable that the shingles be installed in the factory under controlled conditions with the edge rows of shingles being applied after the sections have been joined.

The invention accordingly economically and effectively carries out the aformentioned objectives. Having now therefore described and shown my invention, what I claim to be new and desire to protect by United States Letters Patent is:

1. A building construction for A-frame buildings adapted to be built in a central manufacturing facility and transported to a lot site for final assembly, (a) a pair of complementary bottom building sections adapted to be arranged in side by side relation to form the lower portion of the building, (b) each of said bottom sections having a horizontal floor and an outer side wall, (c) said outer side walls angling upwardly at an acute angle to the floor wherby said side walls will converge toward each other in their upward extension when the sections are side by side, (d) a top section of generally triangular configuration, (e) means for mounting the top section in centered position over said bottom sections, and (f) said top section having outer side walls which converge in their upward extension and are respectively in planar alignment with the outer side walls of the bottom sections to form continuous outer walls therewith.

2. The subject matter of claim 1 wherein said bottom section side walls and said top section side walls are provided with studs, the adjacent end portions of which overlap and are bolted together.

3. The subject matter of claim 1 wherein said bottom sections are provided with abutting floor joists extending longitudinally along the inner edges of the floors thereon, and said joists being bolted together.

4. The subject matter of claim 2 wherein said bottom sections are provided with abutting floor joists extending longitudinally along the inner edges of the floors thereon, and said joists being bolted together.

5. The subject matter of claim 1 wherein said top section is provided with a floor disposed on horizontal plane and a roof connecting the top section side walls.

* * * * *